United States Patent [19]

Caduff

[11] Patent Number: 4,797,969

[45] Date of Patent: Jan. 17, 1989

[54] BUILDING EXTERIOR CLEANING APPARATUS

[76] Inventor: Edward A. Caduff, 258 W. Deer Park Rd., Gaithersburg, Md. 20877

[21] Appl. No.: 1,763

[22] Filed: Jan. 9, 1987

[51] Int. Cl.[4] ..... A47L 1/04

[52] U.S. Cl. ..... 15/302; 15/103

[58] Field of Search ..... 15/302, 421, 103

[56] References Cited

U.S. PATENT DOCUMENTS

| | | | |
|---|---|---|---|
| 3,425,082 | 2/1969 | Hetman | 15/52 |
| 4,112,535 | 9/1978 | Wild et al. | 15/302 X |
| 4,198,724 | 4/1980 | Fisher et al. | 15/302 |

FOREIGN PATENT DOCUMENTS

| | | | |
|---|---|---|---|
| 1350632 | 12/1963 | France | 15/302 |

*Primary Examiner*—Chris K. Moore

*Attorney, Agent, or Firm*—Wigman & Cohen

[57] ABSTRACT

The present invention is directed to a self-contained apparatus for cleaning the vertical surface of a building exterior, including washing, rinsing and drying the windows. The apparatus is positioned by an operator above a vertical row of windows and then remotely operated to clean the exterior building surface as the apparatus descends. The apparatus consists of a housing having a washing chamber, a rinsing chamber, and a drying chamber. The washing chamber has a plurality of cleaning fluid spray heads, a sonic agitator for impinging sonic energy onto the cleaning fluid to aid in removing dirt from the windows, air seals for retaining the fluid in the chamber, and a plurality of air wipes for removing the fluid from the building surface. The rinsing chamber has a plurality of rinsing liquid spray heads, a plurality of air seals to contain the rinsing fluid within the chamber and a plurality of air wipes for removing the fluid from the building surface. The washing chamber, rinsing chamber, and drying chamber are provided with openings communicating with a passageway ending in an exhaust outlet. An exhaust blower disposed in the passageway maintains a negative pressure in each of the chambers. A plurality of axially rotatably mounted vanes are disposed in the openings in order to regulate the negative pressure. Pressure sensors in each of the chambers are operatively connected to the vanes to vary the sizes of the openings to regulate the pressure in the chambers, in response to the actual pressures therein.

19 Claims, 7 Drawing Sheets

BUILDING EXTERIOR CLEANING APPARATUS

BACKGROUND OF THE INVENTION

1. Field of the Invention

This invention relates to a self-contained apparatus for cleaning the vertical surface of a building exterior, including washing the windows, and more particularly to an apparatus which is positioned by an operator above a vertical row of windows and then remotely operated to clean the exterior building surface as the apparatus descends.

Description of the Prior Art

High-rise buildings having fixed glazing have become prevalent in recent years and continue to enjoy great popularity. These buildings have created the necessity of finding a way of cleaning the exterior surface, and architects have responded to the problem in many cases by providing some means of support of scaffolding in the building mullions. In many cases rails have been provided in the mullions so that automated washing machines may be used to clean the exterior building surface. A number of such automatic cleaning devices have been proposed, as for example U.S. Pat. No. 3,604,049 to Hetman; U.S. Pat. No. 3,942,213 to Hohner, Jr.; U.S. Pat. No. 4,025,984 to Hohner, Jr.; U.S. Pat. No. 4,136,419 to Hetman et al; and U.S. Pat. No. 4,198,724 to Fisher et al. It is generally conceded that such machines have not experienced wide acceptance and that a number of problems exist in their application.

U.S. Pat. No. 3,942,213, to Hohner, Jr., for example, describes a wall washing device which uses an air curtain to contain the liquid sprayed against the building exterior. A fan is provided to induce the flow of mist away from the cleaning area and then use the demisted air as an air curtain. The described apparatus, however, employs only a single section for all cleaning functions, and thus is likely to leave a dirty or streaked surface. Nor are means provided for sequencing individual functions, i.e., fluid spray, brushing, wiping, for inset windows, thereby leaving areas at the top and bottom of windows only partially cleaned. In addition, there are no means provided for regulating the pressure in the cleaning chamber and it is thus possible that dirty mist may circulate therein and not be effectively removed.

An additional problem encountered by previous automated washing devices is that of loosening the dirt from the building surface. The prior art means of agitating the dirt loose include direct brush scrubbing, spraying of a liquid, and blowing an air curtain against the surface. Use of air and liquid sprays have been considered to be more desirable than brushing since no direct contact is necessary. However, in the devices, the only way to enhance the loosening power of the spray is to increase the spray pressure, which is inefficient.

SUMMARY AND OBJECTS OF THE INVENTION

In view of the foregoing drawbacks of the prior art cleaning apparatus, as well as other disadvantages not specifically mentioned above, it should be apparent that there exists a need in the art for a cleaning apparatus which is more efficient and effective in removing dirt from the building exterior. It is, therefore, a primary objective of this invention to fulfill this need by providing a means for separating the washing, rinsing and drying chambers and regulating the pressure within said chambers of a building exterior cleaning apparatus.

More particularly, it is an object of this invention to provide axially rotating vanes in openings of the rear wall of the washing chamber, rinsing chamber, and drying chamber so that the size of the openings may be varied to regulate the pressure in the chambers.

It is another object of this invention to provide pressure sensors operatively connected to the vanes in the washing chamber and the drying and rinsing chambers so that the vanes may be rotated to vary the size of the openings in response to the pressure detected in the chambers.

Another primary object of this invention is to provide a building exterior cleaning apparatus having a sonic agitator disposed in the washing chamber for impinging a flow of sonic wave energy of the fluids on the building exterior in order to loosen contaminants covering the surface.

Still another object of this invention is to provide a vertical building exterior surface cleaning apparatus having a sonic agitator disposed in the washing chamber wherein the sonic agitator is so positioned with respect to the fluid spray heads as to give maximum impact to the sonic wave energy emitted by the sonic agitator, thereby creating a cavitational effect on the building surface sufficient to dislodge surface contamination.

Yet another object of the invention is to provide a vertical building exterior surface cleaning apparatus having a sonic agitator disposed in the rinsing chamber and mounted so as to impinge sonic wave energy onto the fluids which contact the surface of the building exterior.

Still another object of the invention is to provide a vertical building exterior surface cleaning apparatus having a sonic agitator disposed in the drying chamber and mounted so as to impinge sonic wave energy onto any fluids which remain on the surface of the building exterior after rinsing has been completed.

Still another object of the invention is to provide for individual movement and control of functions within the washing, rinsing and drying chambers.

Briefly described, the aforementioned objects are accomplished according to the invention by providing a housing having a washing chamber, a rinsing chamber, and a drying chamber, the washing chamber having a plurality of spray heads for impinging a cleaning fluid on the surface of the building exterior, a plurality of air seals for retaining the fluid in the chamber, and a plurality of air wipes for removing the fluid from the building surface.

The rinsing chamber has a plurality of spray heads for impinging a clean rinsing liquid against the surface of the building exterior, and also a plurality of air seals to contain the rinsing fluid within the chamber and a plurality of air wipes for removing the fluid from the building surface. Openings are provided in the washing chamber, rinsing chamber, and drying chamber, the openings communicating with a passageway which ends with an outside exhaust outlet. The passageway contains baffles designed to create turbulence, thereby causing droplets to form sufficiently large so as to drop from the atmosphere and be recirculated.

An exhaust blower disposed in the passageway maintains a negative pressure in each of the washing chamber, rinsing chamber, and drying chamber, a plurality of axially rotatably mounted vanes are disposed in the openings so that the size of the openings may be varied in order to regulate the negative pressure.

Pressure sensors are located within each of the washing chamber, rinsing chamber, and drying chamber and are operatively connected to the vanes so as to vary the sizes of the openings, and thus regulate the pressure in the chambers, in response to the actual pressure therein.

Also disposed in the washing chamber is a sonic agitator which is mounted so as to imping sonic wave energy onto the fluids on the surface of the building exterior. The sonic agitator cooperates with the liquid spray heads and angled air seals to agitate and remove dirt from the glazed panel surface.

Sonic agitators may also be disposed in either the rinsing chamber or drying chamber, or both. When a sonic agitator is disposed in the rinsing chamber it is mounted so as to impinge sonic wave energy onto the rinsing fluids which are sprayed onto the surface of the building exterior. When a sonic agitator is disposed in the drying chamber, it is mounted so as to impinge sonic wave energy onto any fluids which remain on the surface of the building exterior after rinsing has been completed.

With the foregoing and other objects, advantages and features of the invention which will be become hereinafter apparent, the nature of the invention may be more clearly understood by reference to the following detailed description of the invention, the appended claims, and to the several views illustrated in the attached drawings.

DETAILED DESCRIPTION OF A PREFERRED EMBODIMENT

Figure 1:
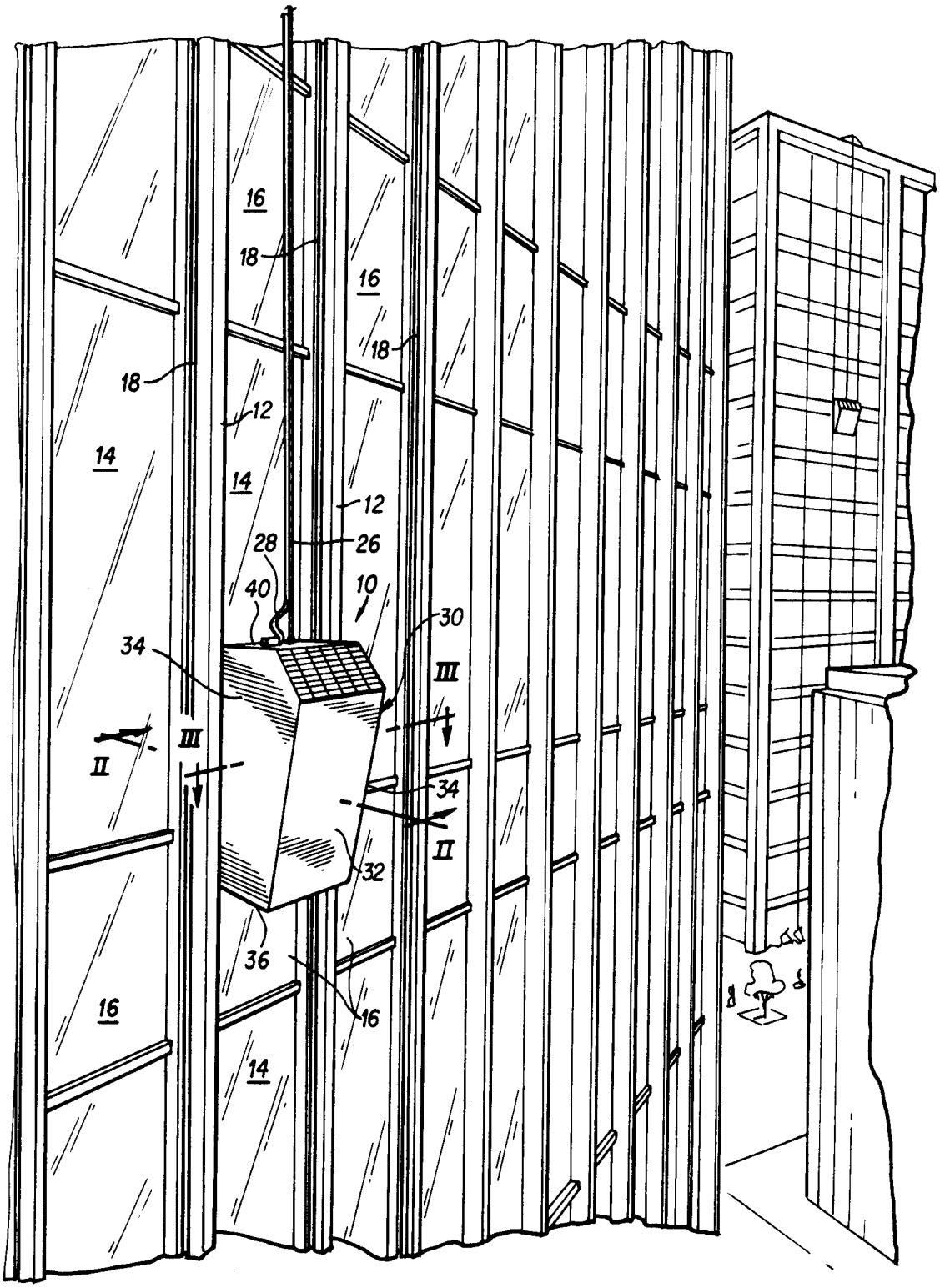
FIG. 1 is a perspective view of the cleaning apparatus according to the invention in position on the vertical surface of a building exterior.
Figure 1A:
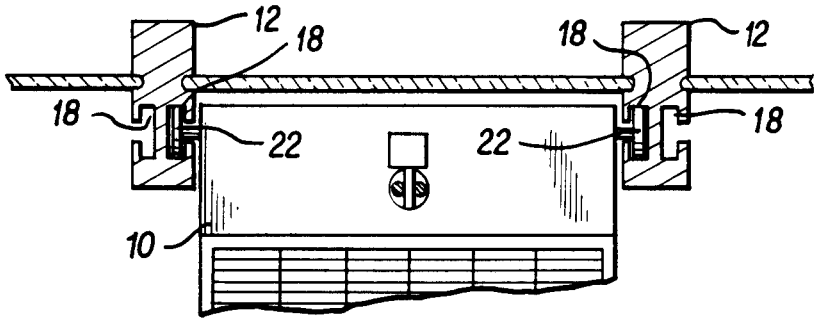
FIG. 1*a* is a plan view of a portion of the cleaning apparatus according to the invention showing one embodiment for guiding the cleaning apparatus for vertical movement.

Referring now in detail to the drawings, wherein like parts are designated by like reference numerals throughout, there is illustrated in FIG. 1 a cleaning apparatus constructed according to a preferred embodiment of the inventon and designated generally by reference numeral 10. Cleaning apparatus 10 is contained within mullions 12 of a high rise building having a building exterior surface formed by fixed glazed panels 14 interspersed with building panels 16 made from a generally decorative building material such as marble or granite slabs, painted steel sheets, porcelain enameled aluminum or steel sheets, anodized aluminum sheets, ceramic tile or the like.

Figure 3:
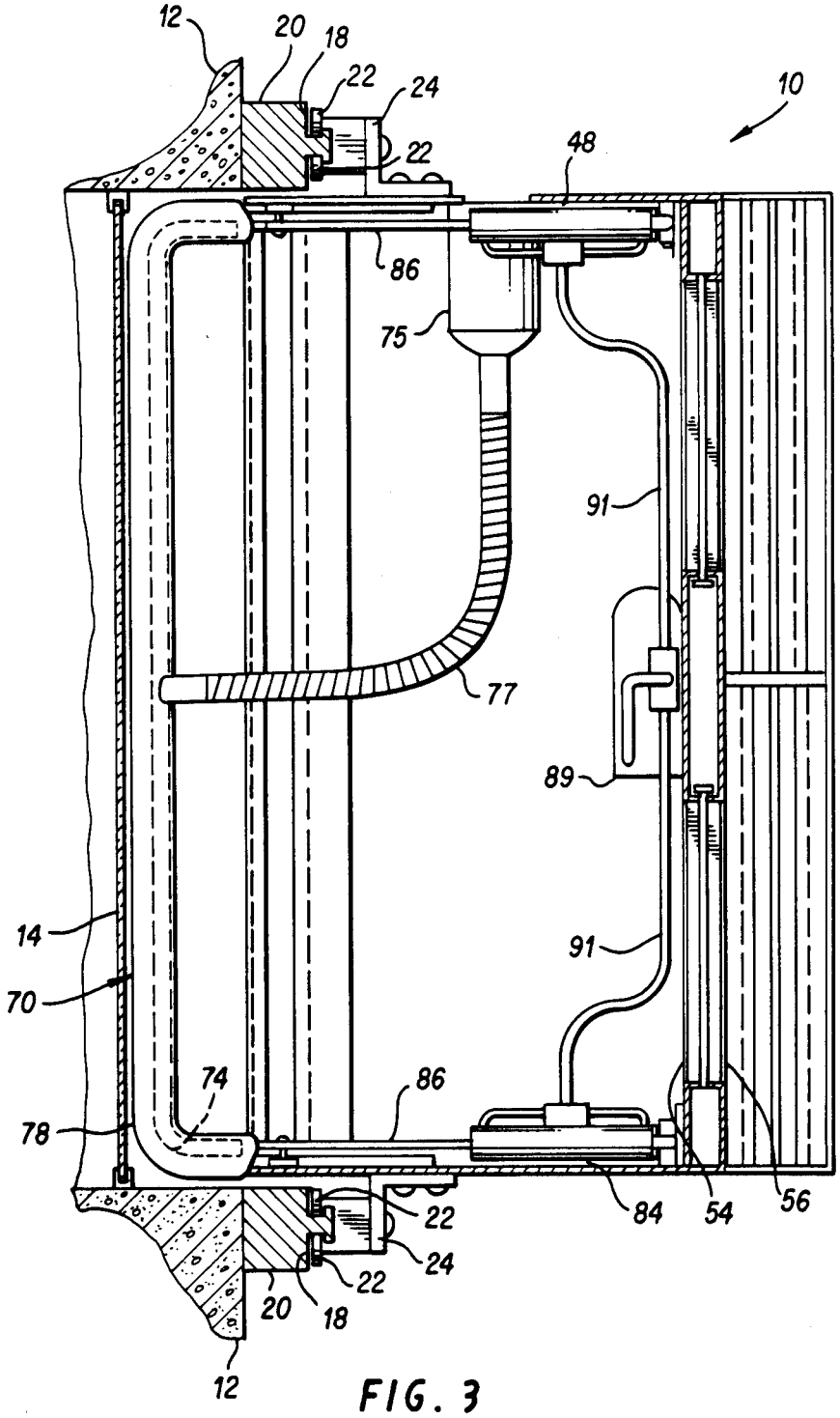
FIG. 3 is a sectional view showing, in particular, the washing chamber of the inventive apparatus taken along a horizontal plane passing through line III—III of FIG. 1.
Figure 4:
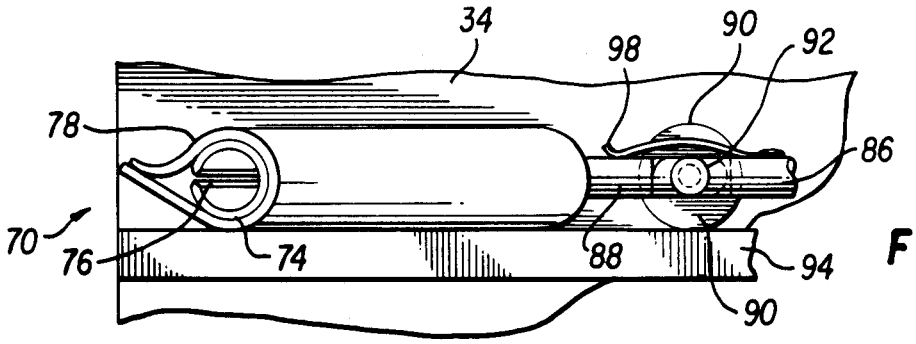
FIG. 4 is a partial elevation showing the air seals of the cleaning apparatus according to the invention.
Figure 5:
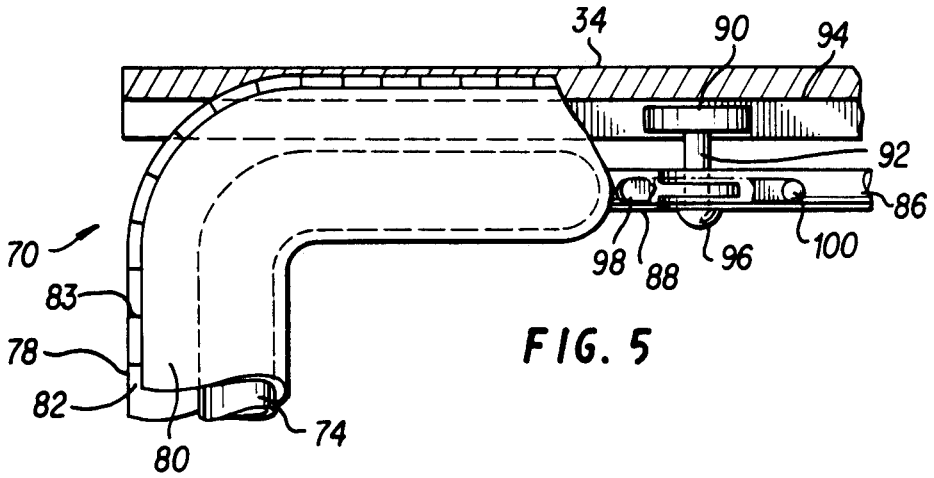
FIG. 5 is a plan view of FIG. 4.

As shown in 1*a*, cleaning apparatus 10 is guided for vertical movement in guide tracks 18 provided in mullions 12 by means of guide wheels 22 mounted on the outside of cleaning apparatus 10. In another embodiment, as shown in FIG. 3, cleaning apparatus 10 is guided in guide tracks 18, mounted to mullions 12 by means of guide rails 20, and by guide wheels 22, mounted on the outside of cleaning apparatus 10 by brackets 24.

Cleaning apparatus 10 is suspended from the roof of the building by cable 26, and is supplied with electrical power through electrical cable 28. Cleaning apparatus 10 is provided with a housing 30 comprising rear wall 32, side walls 34, bottom wall 36, and top wall 40.

Figure 2:
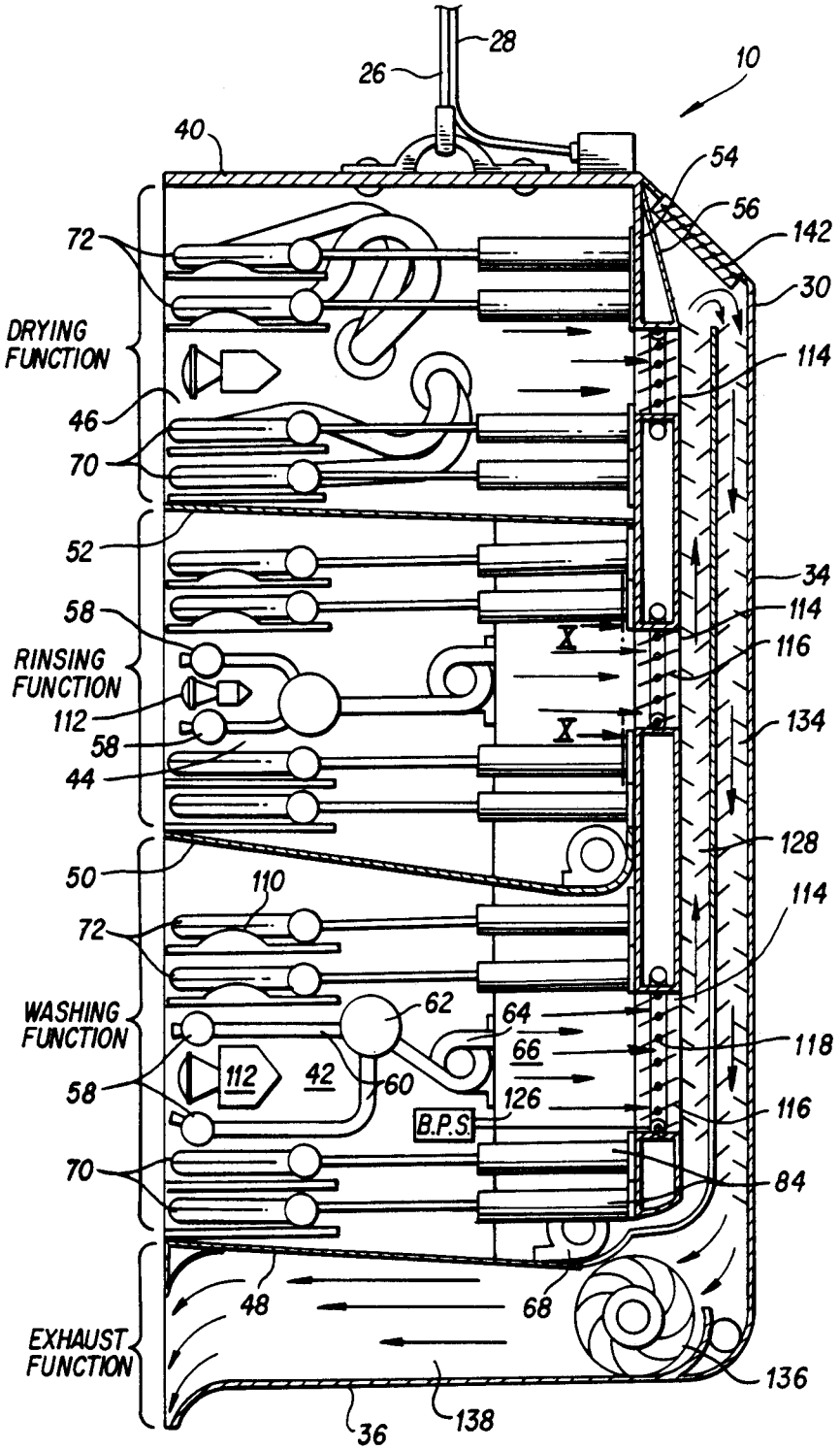
FIG. 2 is a sectional view showing the interior arrangement of the elements of the invention, taken along a vertical plane passing through line II—II of FIG. 1.

With reference now to FIG. 2, cleaning apparatus 10 is provided in its interior with 3 superpositioned chambers; a washing chamber 42, a rinsing chamber 44, and a drying chamber 46. Washing chamber 42, rinsing chamber 44, and drying chamber 46 perform the washing, rinsing, and drying functions, respectively. Three laterally extending floor panels, washing chamber floor panel 48, rinsing chamber floor panel 50, and drying chamber floor panel 52 are provided across the extent of the interior of the cleaning apparatus 10. A pair of vertically extending wall panels, inner chamber wall panel 54, and outer chamber wall panel 56 provide a common rear wall for each of the chambers. Thus, side walls 34 (FIG. 1) of housing 30, washing chamber floor panel 48, rinsing chamber floor panel 50 and inner chamber wall panel 54 define the washing chamber 42. Similarly, rinsing chamber 44 is defined by side walls 34, rinsing chamber floor panel 50, drying chamber floor panel 52, and inner chamber wall panel 54. Drying chamber 46 is defined by side walls 34, drying chamber floor panel 52, top wall 40, and inner chamber rear wall 54.

Disposed within washing chamber 42 are the various elements used for the washing function. Fluid spray heads 58 are fed through supply hoses 60 from a fluid manifold 62 which is fed by supply hose 64 from a detergent tank 66. Detergent tank 66 is provided with suction pump 68 for pumping the detergent in tank 66 through manifold 62 and eventually spray heads 58. It will be noted that washing chamber floor panel 48 is canted toward the base of tank 66 to thereby allow fluids to be recycled. Suitable filters (not shown) are provided to remove the dirt which is washed off the building exterior from the recycled fluid. Also disposed within washing chamber 42 are a plurality of air seals 70 and a plurality of air wipes 72.

Air seals 70 are disposed beneath spray heads 58 and are arranged so as to impinge an upwardly directed flow of air against the building exterior surface. The purpose of air seals 70 is two-fold. First the air seals contain the fluid which is sprayed onto the surface of the building exterior and prevent fluid from escaping. Second, the air flow acts to loosen dirt on the surface of the building exterior. Air wipes 72 are disposed above spray heads 58 and are arranged so as to impinge a downwardly directed flow of air against the building exterior surface, and are used primarily to contain the fluids sprayed by spray heads 58 and act as an air squeegee to remove fluids and contaminants from the building surface.

Referring to FIG. 3 and with further reference to FIGS. 4, 5, 6, and 7, details of the construction of air seals 70 and air wipes 72 are seen. Air seals 70 comprise a central air tube 74 having a slot 76 in its outer periphery. Tube 74 and slot 76 extend laterally across the entire face of the front of the cleaning apparatus and are arranged so as to impinge a continuous air flow across the front of washing chamber 42. Surrounding tube 74 is a flexible sealing skirt 78 which has an upper flap 80 resting thereon to define a skirt opening 82. Pressurized air is supplied to tube 74 by means of an air blower 75 and flexible hosing 77. The air flows out of tube 74 through slot 76 and then out opening 82 to be upwardly directed against the exterior building surface across the entire face of washing chamber 42. Fluid which is sprayed through spray heads 58 against the building's exterior surface is thus trapped by air seals 70 and air wipes 72 (described hereinafter) and returned into the interior of washing chamber 42 where it falls down to washing chamber floor 48 to be collected at the bottom of water tank 66. Sealing skirt 78 is further provided with a plurality of vertically slotted serrations 83 which allow more effective modification of skirt 78 in its sealing function to vertcial support members of windows where so encountered. Thus, when the compressed air curtain strikes sealing skirt 78 it is forced in a flexible manner outwardly towards the juxtaposed exterior building surface to establish a contacting but slideable seal with the vertical surface. The seal can vertically traverse the vertical surfaces from top to bottom as the cleaning device proceeds downwardly with respect to the building face.

Air seals 70 are arranged for lateral extension and withdrawal by a plurality of pneumatic cylinders 84 (FIGS. 2 and 3) through piston shafts 86 and hinge butt shafts 88. A wheel 90 is mounted for free rotation about a wheel shaft 92. Wheel 90 is supported by a horizontal guide means 94 which is fixed with respect to the sidewall 34 of the cleaning apparatus. Wheel shaft 92 is retained on piston shaft 86 and hinge butt shaft 88 by retainer 96. A tension spring 98 is retained at one end of piston shaft 86 by a fastener 100. The other end of tension spring 98 engages hinge butt shaft 88 so as to exert a constant tension tending to maintain piston shaft 86 and hinge butt shaft 88 at a horizontal rest position. A hydraulic pump 89 feeds hydraulic fluid through supply lines 91 to hydraulic cylinders 84. Thus, when the hydraulic pump is actuated through appropriate controls (not shown), such as sensors which are located at the front of the cleaning apparatus to detect variations in the building exterior surface, hydraulic cylinders 84 are actuated to extend or withdraw air seal 70. When air seal 70 is extended or withdrawn by operation of piston shaft 86 and hinge butt shaft 88, air seal 70 is maintained in a horizontal position by wheel 90 riding along its horizontal guide means 94 with the cooperation of springs 98. Air seals 70 are extended toward and withdrawn from the vertical surface of the building exterior in order that they may appropriately contact the building surface during the washing operation or be withdrawn from the building surface in order to allow the seals to pass safely over the building muntins.

Figure 6:
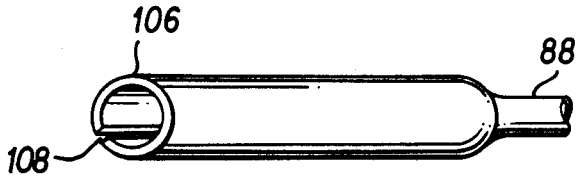
FIG. 6 is a partial elevation showing the air wipes of the cleaning apparatus according to the invention.
Figure 7:
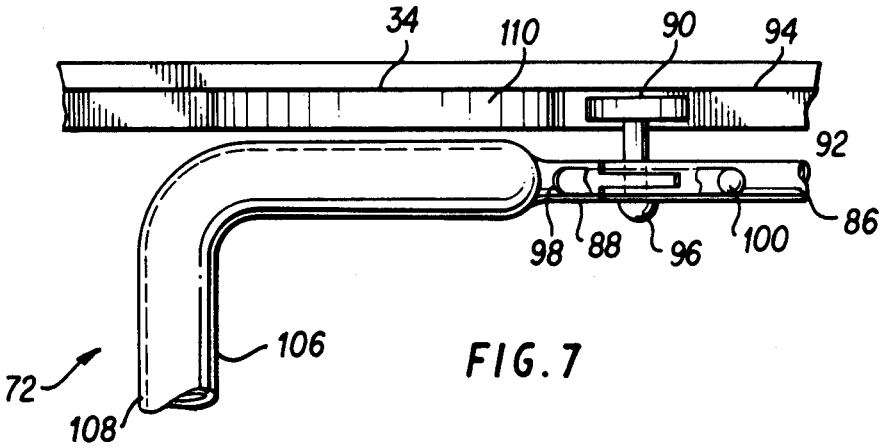
FIG. 7 is a plan view of FIG. 6, with some additional detail illustrated.
Figure 9:
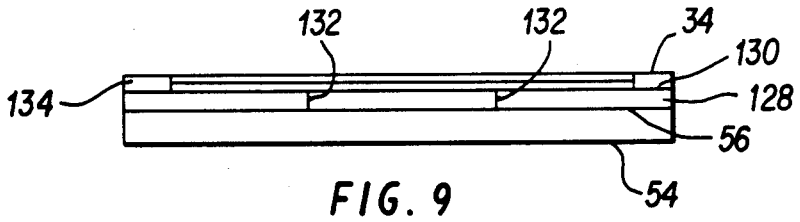
FIG. 9 is a plan view of FIG. 8.

Air wipes 72, as shown in FIGS. 6 and 7, comprise an air distribution tube 106 extending laterally across the entire face of the washing chamber 42. Tube 106 has a slot 108 in the lower, outwardly quadrant so as to direct a flow of air downwardly against the vertical surface of the building exterior when the tube 106 is juxtaposed against the building surface. Similar to air seals 70, air wipes 72 are extended toward and withdrawn from the vertical surface of the building exterior by means of piston shaft 86 connected with hinge butt shaft 88 mounted on wheel shaft 92 of wheel 90, supported on horizontal guide means 94. In addition, however, horizontal guide means 94 is provided with a camming surface 110 (see also FIG. 2), which raises the air wipe 72 together with slot 108 of air distributing tube 106 when the air wipe 72 is extended towards the vertical surface of the building exterior. Air wipes 72 thus begin the wiping function at the extreme upward portion of a window.

Air wipes 72 are provided, similar to air seals 70, with corresponding hydraulic cylinders, a hydraulic pump, and controls so as to extend air shields 70 toward and retract air shield 70 from the verticl surface of the building exterior.

Referring again to FIG. 2, disposed within washing chamber 42 is a sonic agitator 112. Sonic agitator 112 is disposed so as to impinge a flow of sonic wave energy on the vertical surface of the building exterior when the cleaning apparatus 10 is juxtaposed to the building exterior. Sonic agitator 112 is further positioned between fluid spray heads 58. Thus, when a stream of fluid is being directed against the vertical surface of the building exterior, there will be a combination of fluids and fluid mist in the region between the sonic agitator and the vertical surface of the building exterior. This combination of fluid and fluid mist provides the medium for the passage of the sonic waves which are generated by sonic agitator 112.

Sonic agitator 112 is designed so as to produce the appropriate frequency and strength of sonic waves against the vertical surfaces of the building exterior so as to agitate loose particles of dirt which have accumulated on the building exterior. Sonic agitator 112 is provided with an appropriate power source and controls (not shown).

Sonic agitator 112 may be any type of commercially available sonic agitator such as those available from the Sonic Instrument Corp. of Copiague, N.Y.; Ultrasonic Resources Corp. of Roslyn, N.Y.; or Sonic Sonic Systems Inc. of Newtown, Pa. Other suitable sonic agitors may found by consulting the Thomas Register.

Optionally disposed within rinsing chamber 44 is an additional sonic agitator 112 which is mounted so as to impinge sonic wave energy onto the rinsing fluids which contact the surface of the building exterior. Sonic agitator 112 of rinsing chamber 44 is further positioned between fluid spray heads 58 of rinsing chamber 44. Sonic agitator 112 of rinsing chamber 44 operates similarly to sonic agitator 112 of washing chamber 42 and accordingly a separate description has not been provided.

Optionally disposed within drying chamber 46 is an additional sonic agitator 112 which is mounted so as to impinge sonic wave energy onto any fluids which remain on the surface of the building exterior after rinsing has been completed. Since no fluid spray heads 58 are disposed in drying chamber 46, and thus the only source of fluid circulating in drying chamber 46 is the air which is supplied by air seals 70 and air wipes 72 and the fluids which remain on the surface of the building exterior after rinsing has been completed, it will be appreciated that conditions in drying chamber 46 differ from those in washing chamber 42 and rinsing chamber 44. Accordingly, the frequency and strength of sonic waves generated by the sonic agitator in drying chamber 46 must be appropriately adjusted for these conditions.

With further reference to FIG. 2 of the drawings and with reference now to FIGS. 8, 9, 10 and 11, provided at the rear of washing chamber 42, rinsing chamber 44, and drying chamber 46, are rear openings 114, defined by inner chamber wall panel 54 and outer chamber wall panel 56. Disposed within rear openings 114 are a plurality of pressure control vanes 116. Each of the pressure control vanes 116 are mounted for controlled axial rotation about a rod 118. A toothed drive belt 120 interconnects a plurality of vanes 116 and is stretched between upper and lower gears 122, 124, respectively. Upper gear 122 is connected to a dual direction servo motor 125 which is energized in response to a barometric pressure sensor 126 (FIG. 2) located within chambers 42, 44, and 46. For the sake of clarity in the drawings, only one barometric pressure sensor 126, disposed in washing chamber 42, is illustrated in the drawings, but it is to be understood that similar sensors are located in rinsing chamber 44 and drying chamber 46 for similar control of the flow of fluid within cleaning apparatus 10.

Figure 8A:
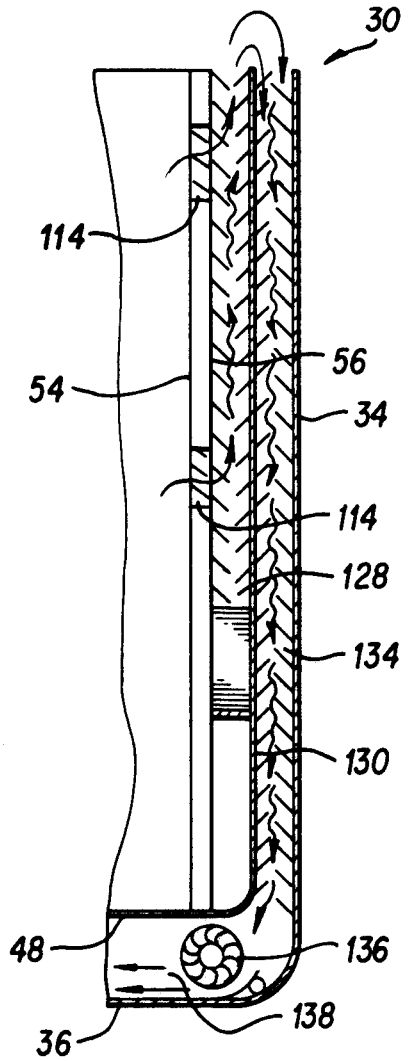
FIGS. 8A and 8B are sectional views taken along lines VIIIA—VIIIA and VIIIB—VIIIB of FIG. 8, respectively.
Figure 8B:
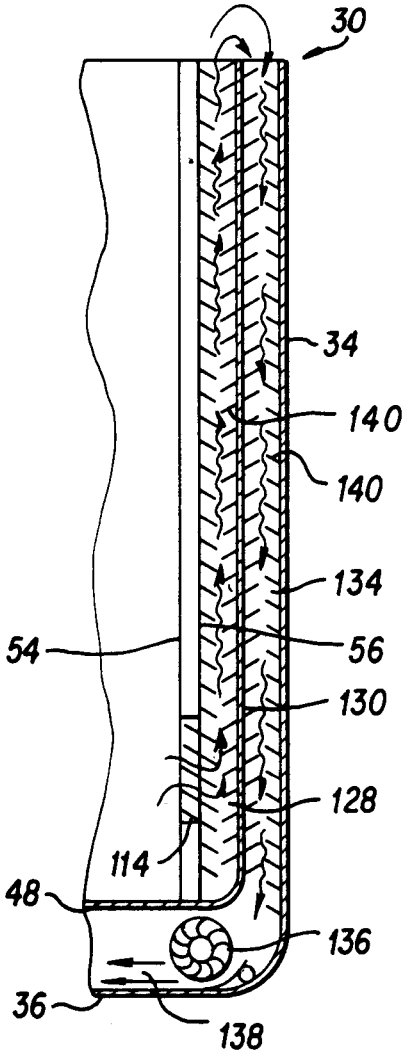
Figure 8:
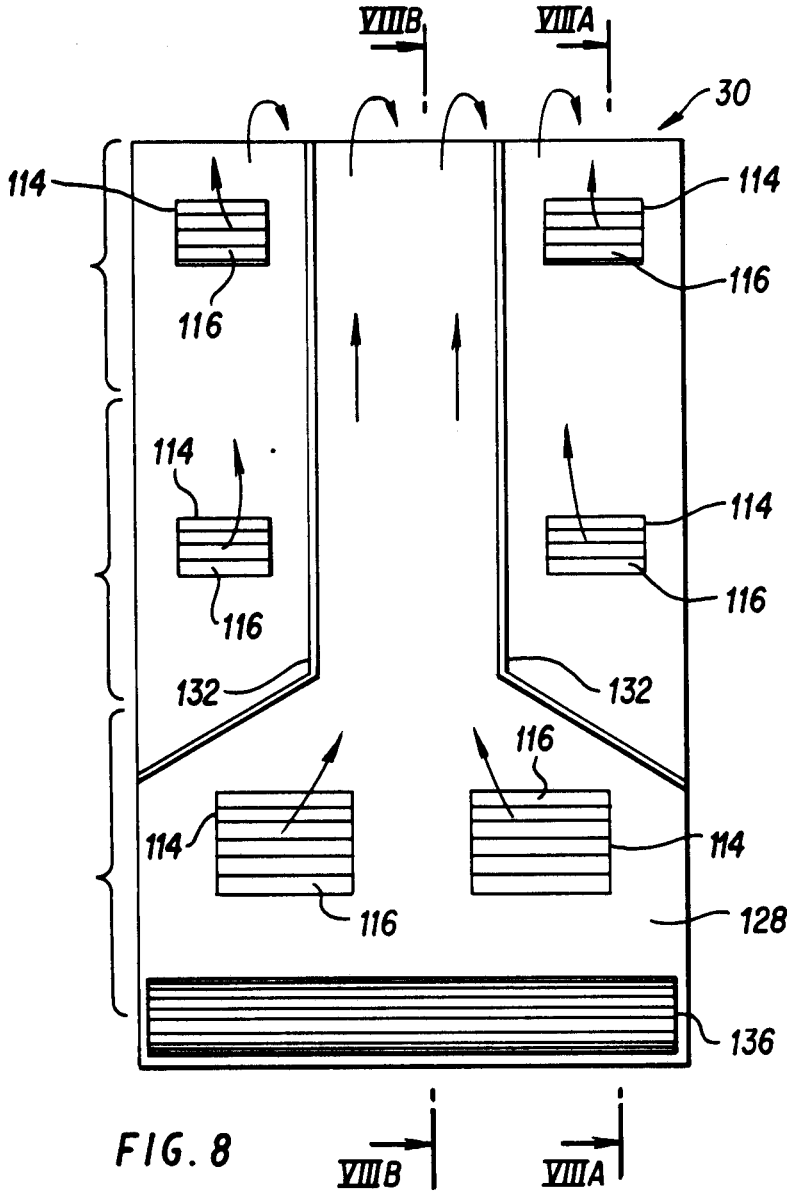
FIG. 8 is a rear elevation of the cleaning apparatus of the present invention with the rear cover removed, illustrating the flow of fluid within the exhaust section of the cleaning apparatus.
Figure 11:
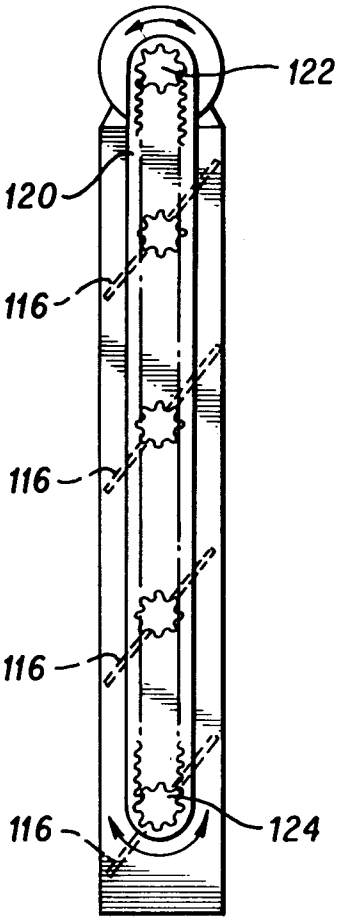
FIG. 11 is a side elevational view of the vane drive mechanism shown in FIG. 10.
Figure 10:
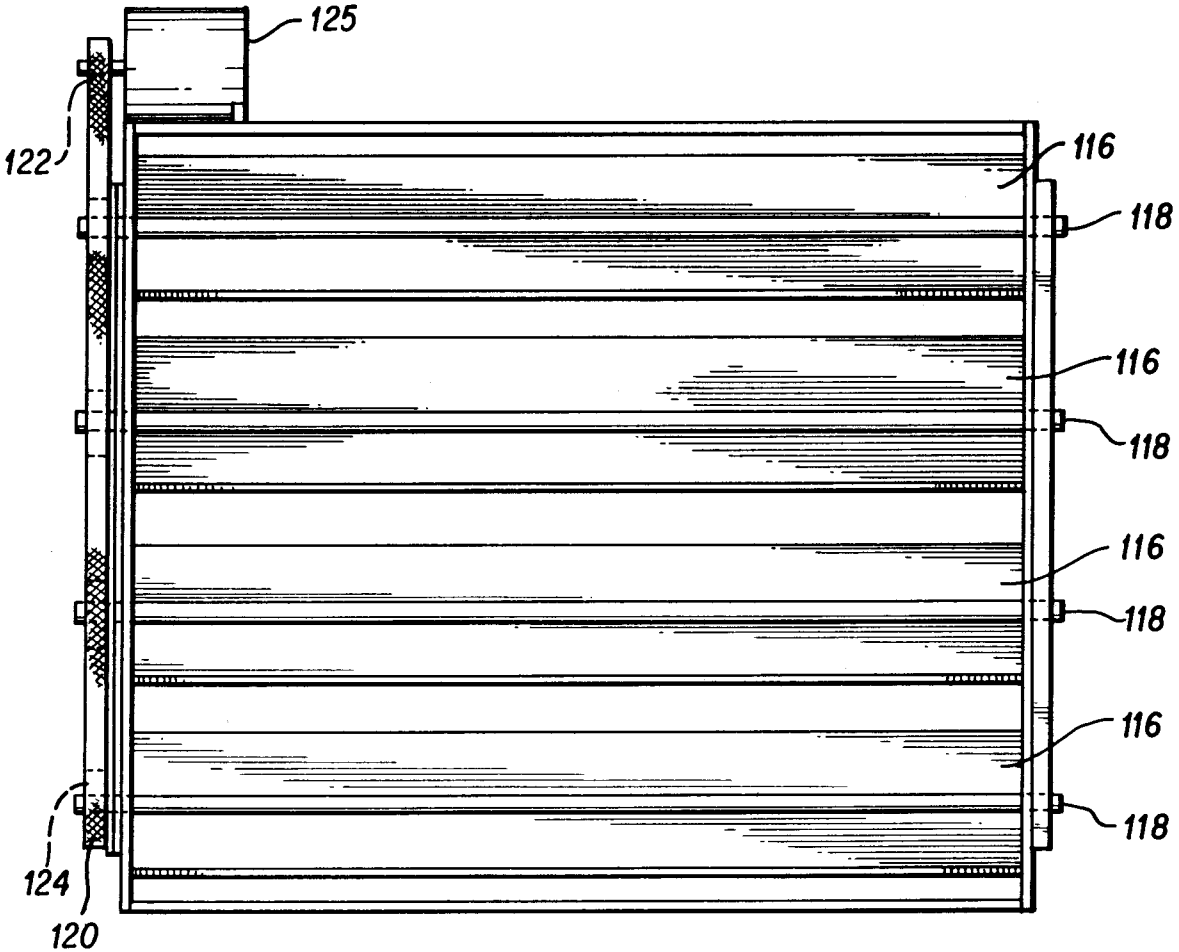
FIG. 10 is an enlarged detail taken along line X—X of FIG. 2, showing the vane drive mechanism according to the invention.

As seen in FIGS. 8 and 8B, openings 114 in washing chamber 42 open into an upward flow channel 128 formed at the rear of housing 30 in the space between an intermediate rear wall 130 and outer chamber wall panel 56. As seen in FIGS. 8 and 8A, openings 114 in rinsing chamber 44 and drying chamber 46 also open into upward flow channel 128. Upward flow channel 128 is further sectioned into separate compartments by vertically extending compartment separators 132 (FIG. 8). A downward flow channel 134 is formed in the space between intermediate rear wall 130 and rear wall 34 of the housing 30. A large capacity radial vane air blower 136 is provided at the rear end of an exhaust channel 138 formed at the bottom of the housing 30 by bottom wall 36 and washing chamber floor panel 48. Exhaust channel 138 terminates in an exhaust outlet which is open to the atmosphere so that fluids may be exhausted from the cleaning apparatus housing 30. Air blower 136 acts to create a negative pressure in each of washing chamber 42, rinsing chamber 44, and drying chamber 46. It is also to be understood that air blower 136 may be replaced by a number of blowers, disposed in each of the compartments of upward flow channel 128, for individual compartment pressure control. The flow of air and fluid from each of the chambers, through openings 114, upward flow channel 128, downward flow channel 134 and exhaust channel 138 is illustrated by the arrows in FIGS. 2, 8, 8A and 8B. At the interior of upward flow channel 128 and downward flow channel 134, a plurality of agitation vanes 140 are provided in order to create turbulance in the flow of fluid through channels 128, 134, thereby removing water droplets from the fluid being drawn through the channels by blower 136. Also included at the top and to the rear of housing 30 are pressure control vanes 142 (FIG. 2), which are rotatable similarly to pressure control vanes 116 in response to a pressure sensor arranged at the top of the confluence of channels 128 and 131 so that exterior air may be introduced to the channels if required when the pressure control vanes 116 are fully closed.

In operation, the building exterior cleaning apparatus 10 of the invention is positioned within a vertical column of building panels 14, 16 from the roof of a building with the guide wheels 22 placed into guide tracks 18 on the building mullions 12, supported by cable 26. The cleaning apparatus 10 is lowered and the sequencing operation of the machine begins. Air seals 70 and air wipes 72 are extended toward the glazed panel 14 by hydraulic cyliners 84 within washing chamber 42 and air is blown into seal 70 and wipe 72 by blower 75. Radial vane blower 136 is started to create a negative pressure in washing chamber 42. Suction pump 68 is started to pump detergent from tank 66 through fluid spray heads 58 against glazed panel 14. At the same time, sonic agitator 112 in washing chamber 42 is activated to impinge sonic wave energy onto the surface of glazed panel 14 via the fluids which contact the surface of the panel. As the cleaning apparatus 10 is lowered, the entire surface of the glazed panel 14 is cleaned, due to the action of the spray of fluid from spray heads 58 in conjunction with the sonic agitator 112 and with the cooperation of air seals 70 and air wipes 72. During this time, the negative pressure created by blower 136 within washing chamber 42 will fluctuate as cleaning apparatus 10 goes through its cleaning cycle. The pressure within washing chamber 42 is sensed by barometric pressure sensor 126, and in response to the pressure which is thereby measured, servo motor 124 is selectively energized to rotate pressure control vanes 116 to adjust the volume of air which is permitted to flow through opening 114, thereby adjusting the pressure within washing chamber 42 to a desired predetermined pressure. The fluid which leaves opening 114 in washing chamber 42 is drawn by blower 136 through upward flow channel 128, through downward flow channel 134 and exhausted into the atmosphere through exhaust channel 138.

When the cleaning apparatus 10 has been sufficiently lowered to expose rinsing chamber 44 to the glazed panel 14, the operating cycle of the machine operates to activate hydraulic cylinders 84 within rinsing chamber 44 to advance air seals 70 and air wipes 72 within rinsing chamber 44 against the glazed panel 14. Air is blown through air seals 70 and air wipes 72 in rinsing chamber 44 as described above with regard to the seals and wipes of washing chamber 42. The pump of the rinse water tank is then activated and rinse water is sprayed from fluid spray heads 58 onto glazed panel 14. Sonic agitator 112 in rinsing chamber 44 is also activated and generates sonic wave energy to loosen contaminants on the glazed panel which may have escaped the washing operation. As the rinsing operation continues, pressure within the rinsing chamber 44 will vary, and a barometric pressure sensor located within rinsing chamber 44 operates to rotate pressure control vanes 116 in rinsing chamber 44 to control the size of opening 114 in rinsing chamber 44. Fluid which flows from rinsing chamber 44 through opening 114 is directed into upward flow channel 128, into downward flow channel 134, drawn by blower 136, and is exhausted into the atmosphere through exhaust channel 138.

As cleaning apparatus 10 continues to be lowered, drying chamber 46 is exposed to glazed panel 14 and the operating cycle activates hydraulic cylinders 84 of drying chamber 46 to advance air seals 70 and air wipes 72 of drying chamber 46. Sonic agitator 112 of drying chamber 46 is activated and generates sonic wave energy which impinges against glazed panel 14 via fluids which remain on the panel after rinsing has been completed, thereby further agitating loose from the surface of panel 14 any contaminants which may have escaped the washing and rinsing operations. Negative pressure created within drying chamber 46 by blower 136, in combination with air which is blown on the panel by air seals 70 and air wipes 72, acts to dry the surface of glazed panel 14. During the course of drying operation, the pressure within drying chamber 46 will vary. In order to control this variation, a barometric pressure sensor is located in drying chamber 46 and connected with presssure control vanes 116 positioned within opening 114 of drying chamber 46 to adjust the size of the opening and thus control the pressure within drying chamber 46. Fluids which are removed from drying chamber 46 pass through opening 114 and are directed into upward flow channel 128, into downward flow channel 134, drawn by blower 136, and pass through exhaust channel 138 where they are exhausted to the atmosphere.

As the cleaning apparatus 10 continues on its vertical descent, each glazed panel 14 is successively washed, rinsed, and dried by the functioning of the various section of the cleaning apparatus until the lowermost glazed panel 14 has been cleaned. The operational cycle of the machine then deactivates all machine functions, cleaning apparatus 10 is hauled to the roof, and repositioned in the next successive pair of mullions and the cycle is recommenced.

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. A vertical building exterior cleaning apparatus comprising:

a housing;

a washing chamber disposed in said housing, said washing chamber having means for impinging a cleaning fluid on the building exterior;

a rinsing chamber disposed in said housing, said rinsing chamber having means for impinging a rinsing fluid on the building exterior;

means for maintaining a negative pressure in the interior of said washing and rinsing chambers; and means for regulating the negative pressure in said washing chamber and said rinsing chamber;

wherein said washing and said rinsing chambers have openings defined therein and said means for regulating the negative pressure in said washing chamber and said rinsing chamber comprises a plurality of vanes axially rotatably mounted in said openings for varying the size of said openings.

2. The vertical building exterior cleaning apparatus of claim 1 wherein said means for maintaining a negative pressure in said washing chamber and said rinsing chamber comprises an exhaust blower disposed in a passageway communicating at one end with an outside exhaust outlet and at the other end with said washing chamber opening and said rinsing chamber opening.

3. The vertical building exterior cleaning apparatus of claim 2 wherein said passageway, in the area between said chamber openings and said exhaust blower, comprises a plurality of baffles for removal of water vapor from air passing through said passageway.

4. The vertical building exterior cleaning apparatus of claim 1 further comprising:

a pressure sensor located in said washing chamber operatively connected with the vanes mounted in the opening of the washing chamber wherein the size of said washing chamber opening may be varied in response to the pressure in said washing chamber; and a pressure sensor located in said rinsing chamber operatively connected with the vane mounted in the opening of the rinsing chamber wherein the size of said rinsing chamber opening may be varied in response to the pressure in said rinsing chamber.

5. The vertical building exterior cleaning apparatus of claim 1 further comprising:

a drying chamber disposed in said housing, said drying chamber being exposed to the building exterior;

means for maintaining a negative pressure in said drying chamber whereby fluids on the surface of the building exterior are drawn from the surface of the building exterior into said drying chamber; and means for regulating the negative pressure in said drying chamber.

6. The vertical building exterior cleaning apparatus of claim 5 wherein said drying chamber has an opening defined therein and said means for regulating the negative pressure in said drying chamber comprises a plurality of vanes axially rotatably mounted in said opening for varying the size of the opening.

7. The vertical building exterior cleaning apparatus of claim 6 wherein said means for maintaining a negative pressure in said drying chamber comprises an exhaust blower disposed in a passage way communicating at one end with an outside exhaust outlet and at the other end with said drying chamber opening.

8. The vertical building exterior cleaning apparatus of claim 7 wherein said passageway, in the area between said chamber opening and said exhaust blower, comprises a plurality of baffles for removal of water vapor from air passing through said passageway.

9. The vertical building exterior cleaning apparatus of claim 8 further comprising:

a pressure sensor located in said drying chamber operatively connected with the vanes mounted in the opening of the drying chamber wherein the size of said dryer chamber may be varied in response to the pressure in said drying chamber.

10. The vertical building exterior cleaning apparatus of claim 5 wherein said means for impinging a flow of cleaning fluid on the building exterior comprises a plurality of fluid spray heads and said sonic agitator is positioned between said fluid spray heads.

11. A vertical building exterior cleaning apparatus comprising:

a washing chamber having means disposed therein for impinging a flow of cleaning fluid on the building exterior; and a sonic agitator disposed in said washing chamber for impinging a flow of sonic wave energy on said building exterior.

12. The vertical building exterior cleaning apparatus of claim 11 further comprising:

a rinsing chamber having means disposed therein for impinging a flow of rinsing fluid on the building exterior; and a sonic agitator disposed in said rinsing chamber for impinging a flow of sonic wave energy on said building exterior.

13. The vertical building exterior cleansing appratus of claim 12 wherein said means for impinging a flow of rinsing fluid on the building exterior comprises a plurality of fluid spray heads and said rinsing chamber sonic agitator is positioned between said rinsing chamber fluid spray heads.

14. The vertical building exterior cleaning apparatus of claim 12 further comprising:

a drying chamber having means disposed therein for impinging a flow of drying fluid on the building exterior; and a sonic agitator disposed in the drying chamber for impinging a flow of sonic wave energy on the building exterior.

15. The vertical building exterior cleaning apparatus of claim 11 further comprising:

a drying chamber having means disposed therein for impinging a flow of drying fluid on the building exterior; and a sonic agitator disposed in the drying chamber for impinging a flow of sonic wave energy on said building exterior.

16. The vertical building exterior cleaning apparatus of claim 15 wherein said means impinging a flow of drying fluid on the building exterior comprises an air seal and an air wipe and said drying chamber sonic agitator is positioned between said seal and said air wipe.

17. The vertical building exterior cleaning apparatus of claim 15 wherein said means for impinging a flow of drying fluid on the building exterior comprises a plurality of air seals and a plurality of air wipes.

18. A vertical building exterior cleaning apparatus comprising:

a housing;

a washer chamber disposed in said housing, said washing chamber having means for impinging a cleaning fluid on the building exterior;

a rinsing chamber disposed in said housing, said rinsing chamber having means for impinging a rinsing fluid on the building exterior;

means for maintaining a negative pressure in the interior of said washing and rinsing chambers; and means including vanes for regulating the negative pressure in said washing chamber and said rinsing chamber.

19. A vertical building exterior cleaning apparatus comprising:

a housing;

a washing chamber disposed in said housing said washing chamber having means for impinging a cleaning fluid on the building exterior;

a rinsing chamber disposed in said housing, said rinsing chamber having means for impinging a rinsing fluid on the building exterior;

means for sensing the pressure in said washing and rinsing chambers;

means for maintaining a negative pressure in the interior of said washing and rinsing chambers; and means for responsive to said sensing means for regulating the negative pressure in said washing chamber and said rinsing chamber.

* * * * *